US006914534B2

(12) United States Patent
Tanguay

(10) Patent No.: US 6,914,534 B2
(45) Date of Patent: Jul. 5, 2005

(54) ENHANCED VISUAL SIGNALING FOR AN ADVERSE CONDITION DETECTOR

(75) Inventor: William P. Tanguay, Downers Grove, IL (US)

(73) Assignee: Maple Chase Company, Downers Grove, IL (US)

( * ) Notice: Subject to any disclaimer, the term of this patent is extended or adjusted under 35 U.S.C. 154(b) by 140 days.

(21) Appl. No.: 10/300,386

(22) Filed: Nov. 20, 2002

(65) Prior Publication Data

US 2004/0095253 A1 May 20, 2004

(51) Int. Cl.[7] ..... G08B 17/10
(52) U.S. Cl. ..... 340/628; 340/286.05; 340/577; 340/815.45
(58) Field of Search ..... 340/628, 286.05, 340/532, 531, 426.24, 554.2, 539.26, 577, 632, 517, 815.45, 815.65, 815.73

(56) References Cited

U.S. PATENT DOCUMENTS 5,526,280 A * 6/1996 Consadori et al. ..... 702/24
6,329,924 B1 * 12/2001 McNulty ..... 340/660
6,426,703 B1 * 7/2002 Johnston et al. ..... 340/628

OTHER PUBLICATIONS

First Alert, Model SC01N—User's Manual, 10/99.
"AC Powered Smoke And Carbon Monoxide Alarm With Battery Back–Up And Silence Feature", Model SC 6120B User's Manual, BRK Electronics, pp. 1–30, Jan., 2002.

* cited by examiner

*Primary Examiner*—Jeffery Hofsass
*Assistant Examiner*—Jennifer Stone
(74) *Attorney, Agent, or Firm*—Andrus, Sceales, Starke & Sawall, LLP

(57) ABSTRACT

An adverse condition detector that allows the user to visually determine the type of adverse condition being detected. The adverse condition detector includes a sensor and a control unit coupled to the sensor. When the sensor detects an adverse condition above a selected level, the control unit generates an audible alarm signal and a visual alarm signal. The visual alarm signal simulates the type of adverse condition being detected. In one embodiment of the invention, the visual alarm signal includes a plurality of visual indicators operated in a random fashion to simulate the appearance of a flame.

23 Claims, 4 Drawing Sheets

ENHANCED VISUAL SIGNALING FOR AN ADVERSE CONDITION DETECTOR

BACKGROUND OF THE INVENTION

The present invention generally relates to an adverse condition detector that includes a sensor for detecting an adverse condition in a building. More specifically, the present invention is directed to a method and apparatus for providing an enhanced visual alarm signal such that the user can more quickly and easily determine what type of adverse condition is being sensed by the adverse condition detector.

Alarm systems that detect dangerous conditions in a home or business, such as the presence of smoke, carbon dioxide or other hazardous elements, are extensively used to prevent death or injury. In recent years, it has been the practice to develop adverse condition detectors that detect more than one type of adverse condition within a single unit. For example, detectors are currently available that include multiple sensors, such as a CO sensor and a smoke sensor, such that if either of these adverse conditions is detected, the single adverse condition detector can generate an audible alarm signal to the user indicating the type of adverse condition being detected.

Presently, combination adverse condition detectors that sense both the presence of CO and smoke emit different audible alarms depending upon the type of adverse condition being detected. The smoke alarm audible signal is defined by Underwriters Laboratory and is referred to as the Universal Evacuation Signal. The Universal Evaluation Signal has three moderate length tones separate by two moderate length pauses and a third longer pause, with the entire process repeating every four seconds.

In contrast, the CO temporal audible signal defined by UL includes four very rapid pulses occurring in less than one second with a pause of about five seconds until the next sequence of pulses. Thus, the two audible signals can be distinguished by a user that is aware of the different sounds for each of the audible alarm signals. However, a limitation exists in that the user of the adverse condition detector must know and be able to distinguish the two types of audible alarms generated by the single adverse condition detector.

Since many users only hear the two different audible patterns during a manual test of the detector, these users are unable to remember and distinguish the two different audible alarm patterns during an alarm situation. Thus, many manufacturers have determined that the use of a visual signal in addition to the audible alarm signal is an effective manner to communicate to the user the type of alarm signal being generated by a single multi-sensor adverse condition detector.

One example of a combination alarm having differing visual signals is the BRK Model No. SC01SCL. In this product, a red LED is simultaneously flashed with the smoke alarm signal to indicate to the user that the device is sensing smoke. The red LED is positioned behind a red plastic lens that in turn is positioned behind a cutout in the detector housing that resembles a flame. Thus, the user is led to associate the smoke audible alarm signal with the flashing of the red LED behind the flame cutout. Similarly, the device uses another separate red LED positioned behind a triangle-shaped cutout that simulates the shape of a molecule of gas. The second red LED is flashed along with the generation of the CO alarm signal such that the user can visually associate the flashing of the red LED behind the molecule cutout as a CO sensing.

Various other manufacturers have used different color LEDs to indicate the two types of alarm conditions being sensed. Although the two types of LEDs for the two types of adverse conditions being sensed provide a reliable technique to differentiate the two types of alarm signals, the LEDs are typically positioned within a cutout that must be visually examined by the user to determine what type of signal is being generated. Therefore, if the alarm signals are being generated in a dark building, it is difficult for the user to immediately associate the visual signal being generated with one of the types of adverse conditions being sensed.

Yet another manufacturer has developed a combination alarm that includes a single red LED that flashes when either the CO audible temporal signal or the audible smoke temporal signal is being generated. The red LED flashes simultaneously with the horn activation. In addition to the single flashing LED, the alarm utilizes a voice announcement during the sound between the horn pulses to differentiate the type of signal. For example, in a smoke event, the alarm tone sounds and the message "Fire! Fire!" is relayed. Likewise, in a CO event, the alarm tone sounds and a user hears the warning "Warning! Carbon Monoxide". Although this type of alarm system works well with a user that understands English, a non-English speaking user would be unable to distinguish the types of alarms being generated.

Therefore, a need exists for an improved method of alerting a user of an adverse condition detector of the type of adverse condition being detected by the detector during an alarm condition. Specifically, a need exists for an adverse condition detector that generates a visual signal that allows the user to immediately associate the visual signal with the type of adverse condition being detected.

SUMMARY OF THE INVENTION

The present invention provides an adverse condition detector that generates a visual alarm signal that simulates the type of adverse condition being detected such that a user is able to visually determine the type of adverse conditions present. The detector of the invention includes a control unit coupled to an adverse condition sensor that is operable to detect an adverse condition in an area near the detector. When an adverse condition is detected, the control unit generates an audible alarm signal through an audible indicator, such as a horn, coupled to the control unit. In one embodiment of the invention, the audible alarm signal has a series of repeating alarm periods each having a plurality of alarm pulses separated by an off periods.

During generation of the audible alarm signal, the control unit generates a visual alarm signal that indicates to the user the type of alarm condition being detected. In accordance with the present invention, the visual alarm signal visually simulates the type of adverse condition triggering the alarm such that the user can quickly and easily determine the type of adverse condition being detected.

The adverse condition detector of the present invention includes a plurality of visual indicators each coupled to the control unit. Each of the visual indicators can be operated independently by the control unit. Preferably, the visual indicators each are capable of generating a different color light than the remaining visual indicators such that the visual indicators can be selectively operated to generate changing light colors.

During detection of the adverse condition, the control unit sequentially flashes the visual indicators on and off in a pattern that simulates the type of adverse condition being detected. In one embodiment of the invention, the visual indicators are three different colored LEDs. In an embodiment in which the adverse condition detector is a smoke alarm, the three LEDs are selected from the colors orange, yellow and red, such that the LEDs can simulate the appearance of a flickering flame.

The microprocessor control unit of the adverse condition detector includes a stored operational sequence that defines the sequence of operation of the visual indicators. Preferably, the operational sequence allows the control unit to operate only one visual indicator at a time in order to conserve the power supply for the detector.

The operational sequence stored in the microprocessor control unit includes directions to flash each of the visual indicators on for only an activation period. After the expiration of the activation period, another of the visual indicators is flashed on for another activation period. Preferably, the activation period is short in duration and numerous sequential activation periods define the visual alarm signal. The operational sequence is selected to flash the visual indicators on and off to create a "random" appearance to the visual alarm signal.

In one embodiment of the invention, the visual alarm signal is generated only during the off period between pulses of the audible alarm signal. Each off period of the audible alarm signal is divided into multiple time slots each having the duration of the activation period such that the visual indicators can be operated according to the operational sequence during the off period of the alarm signal.

The generation of the visual alarm signal by the microprocessor control unit allows a user to visually examine the adverse condition detector during the generation of an alarm signal and quickly determine the type of adverse condition being detected. The generation of the visual alarm signal in accordance with the present invention does not require the user to have any knowledge of the audible alarm patterns or speak a specific language in order to determine the type of adverse condition being detected.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
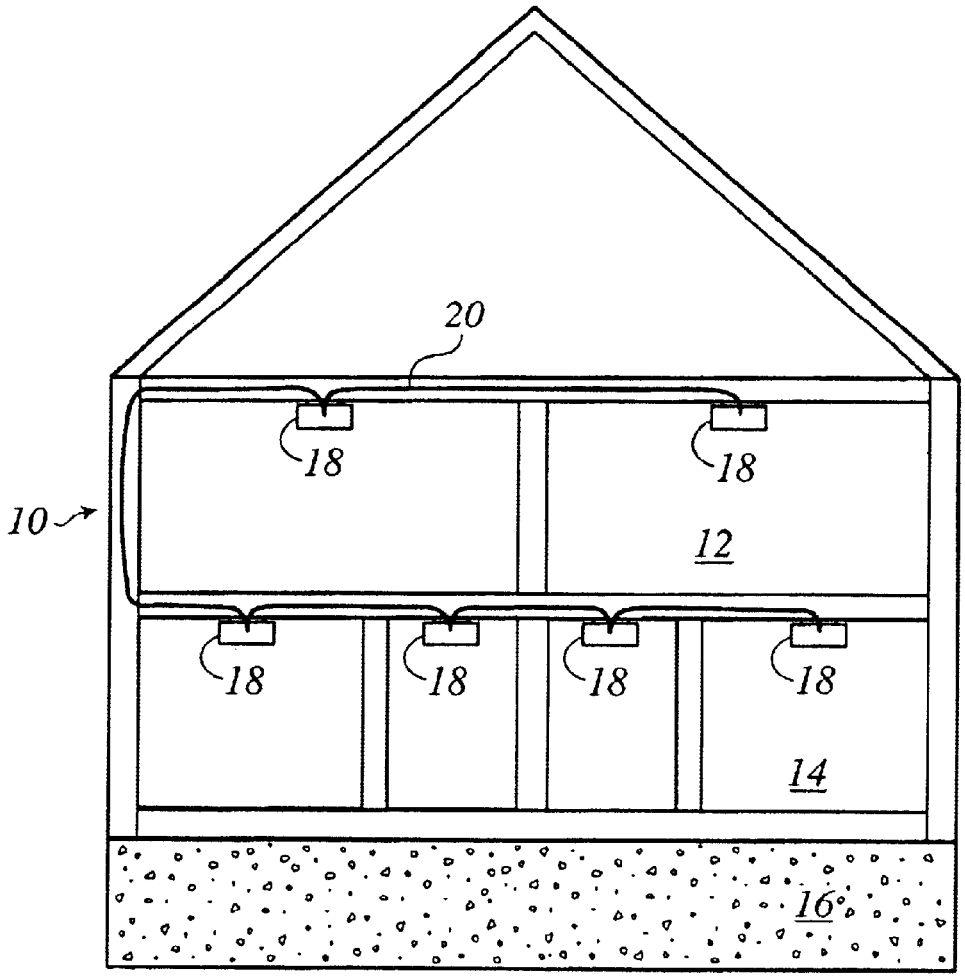
FIG. 1 is a general view of a plurality of remote adverse condition detectors that are interconnected with a pair of common conductors.

FIG. 1 illustrates a facility 10 having multiple levels 12, 14 and 16 with rooms on each level. As illustrated, an adverse condition detector 18 is located in each of the rooms of the facility 10 and the detectors 18 are interconnected by a pair of common conductors 20. The plurality of adverse condition detectors 18 can communicate with each other through the common conductors 20.

In FIG. 1, each of the adverse condition detectors 18 is configured to detect a dangerous condition that may exist in the room in which it is positioned. Generally speaking, the adverse condition detector 18 may include any type of device for detecting an adverse condition for the given environment. For example, the detector 18 could be a smoke detector (e.g., ionization, photo-electric) for detecting smoke indicating the presence of a fire. Other detectors could include but are not limited to carbon monoxide detectors, aerosol detectors, gas detectors including combustible, toxic and pollution gas detectors, heat detectors and the like.

In the embodiment of the invention to be described, the adverse condition detector 18 is a combination smoke and carbon monoxide detector, although the features of the present invention could be utilized in many of the other detectors currently available or yet to be developed that provide an indication to a user that an adverse condition exists.

Figure 2:
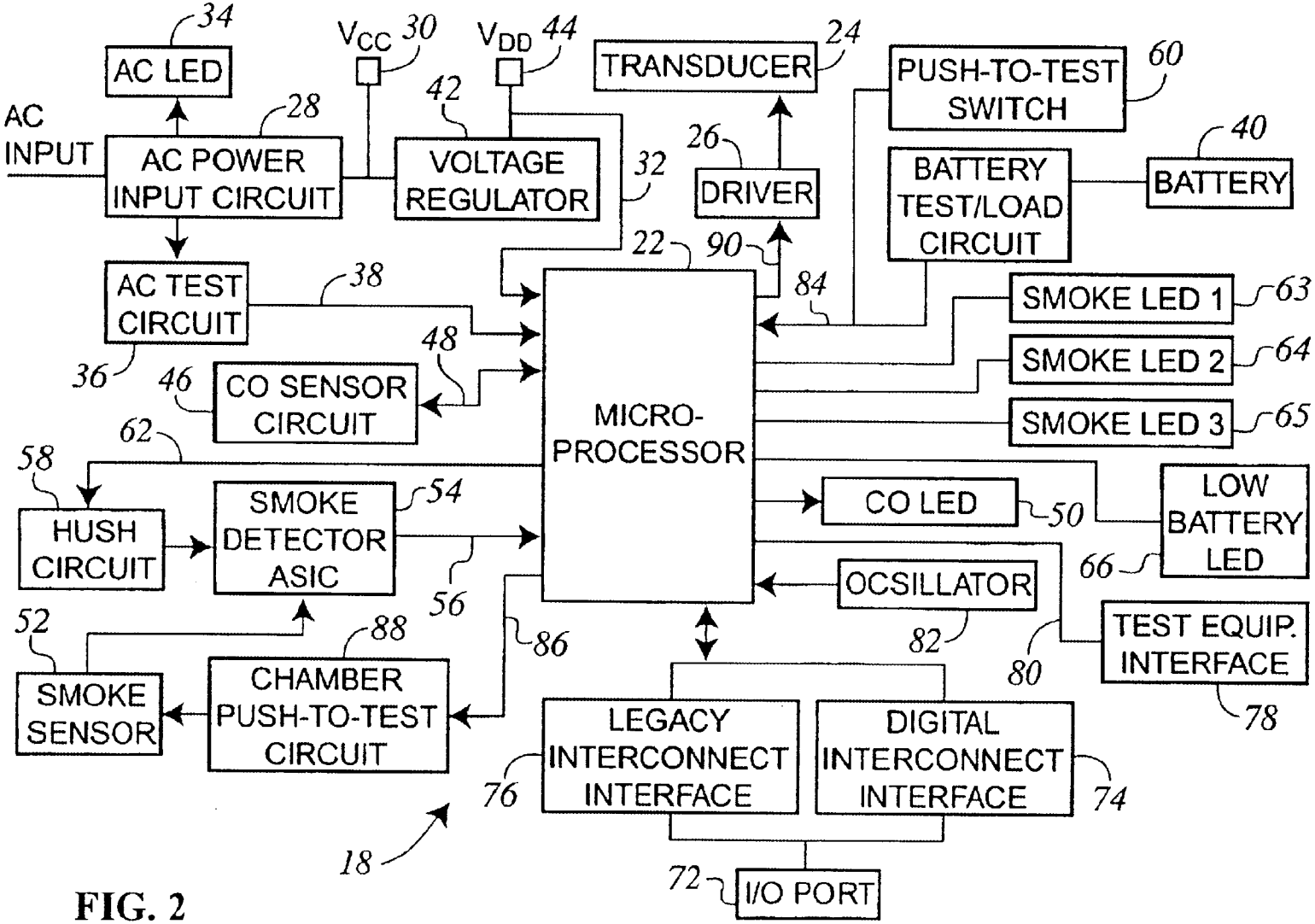
FIG. 2 is a block diagram of an adverse condition detector apparatus of the present invention.

Referring now to FIG. 2, thereshown is a block diagram of the adverse condition detector 18 of the present invention. As described, the adverse condition detector 18 of the present invention is a combination smoke and CO detector.

The adverse condition detector 18 includes a central microprocessor 22 that controls the operation of the adverse condition detector 18. In the preferred embodiment of the invention, the microprocessor 22 is available from Microchip as Model No. PIC16LF73, although other microprocessors could be utilized while operating within the scope of the present invention. The block diagram of FIG. 2 is shown on an overall schematic scale only, since the actual circuit components for the individual blocks of the diagram are well known to those skilled in the art and form no part of the present invention.

As illustrated in FIG. 2, the adverse condition detector 18 includes an alarm indicator or transducer 24 for alerting a user that an adverse condition has been detected. Such an alarm indicator or transducer 24 could include but is not limited to a horn, a buzzer, siren, flashing lights or any other type of audible or visual indicator that would alert a user of the presence of an adverse condition. In the embodiment of the invention illustrated in FIG. 2, the transducer 24 comprises a piezoelectric resonant horn, which is a highly efficient device capable of producing an extremely loud (85 dB) alarm when driven by a relatively small drive signal.

The microprocessor 22 is coupled to the transducer 24 through a driver 26. The driver 26 may be any suitable circuit or circuit combination that is capable of operably driving the transducer 24 to generate an alarm signal when the detector detects an adverse condition. The driver 26 is actuated by an output signal from the microprocessor 22.

As illustrated in FIG. 2, an AC power input circuit 28 is coupled to the line power within the facility. The AC power input circuit 28 converts the AC power to an approximately 9 volt DC power supply, as indicated by block 30 and referred to as $V_{CC}$. The adverse condition detector 18 includes a green AC LED 34 that is lit to allow the user to quickly determine that proper AC power is being supplied to the adverse condition detector 18.

The adverse condition detector 18 further includes an AC test circuit 36 that provides an input 38 to the microprocessor 22 such that the microprocessor 22 can monitor for the proper application of AC power to the AC power input circuit 28. If AC power is not available, as determined through the AC test circuit 36, the microprocessor 22 can switch to a low-power mode of operation to conserve energy and extend the life of the battery 40.

The adverse condition detector 18 includes a voltage regulator 42 that is coupled to the 9 volt $V_{CC}$ 30 and generates a 3.3 volt supply $V_{DD}$ as available at block 44. The voltage supply $V_{DD}$ is applied to the microprocessor 22 through the input line 32, while the power supply $V_{CC}$ operates many of the detector-based components as is known.

In the embodiment of the invention illustrated in FIG. 2, the adverse condition detector 18 is a combination smoke and carbon monoxide detector. The detector 18 includes a carbon monoxide sensor circuit 46 coupled to the microprocessor 22 by input line 48. In the preferred embodiment of the invention, the CO sensor circuit 46 includes a carbon monoxide sensor that generates a carbon monoxide signal on input line 48. Upon receiving the carbon monoxide signal on line 48, the microprocessor 22 determines when the sensed level of carbon monoxide has exceeded one of many different combinations of concentration and exposure time (time-weighted average) and activates the transducer 24 through the driver 26 as well as turning on the carbon monoxide LED 50. In the preferred embodiment of the invention, the carbon monoxide LED 50 is blue in color, although other variations for the carbon monoxide LED are contemplated as being within the scope of the present invention.

In the preferred embodiment of the invention, the microprocessor 22 generates a carbon monoxide alarm signal to the transducer 24 that is distinct from the alarm signal generated upon detection of smoke. The specific audible pattern of the carbon monoxide alarm signal is an industry standard and is thus well known to those skilled in the art.

In addition to the carbon monoxide sensor circuit 46, the adverse condition detector 18 includes a smoke sensor 52 coupled to the microprocessor through a smoke detector ASIC 54. The smoke sensor 52 can be either a photoelectric or ionization smoke sensor that detects the presence of smoke within the area in which the adverse condition detector 18 is located. In the embodiment of the invention illustrated, the smoke detector ASIC 54 is available from Allegro as Model No. A5368CA and has been used as a smoke detector ASIC for numerous years.

When the smoke sensor 52 senses a level of smoke that exceeds a selected value, the smoke detector ASIC 54 generates a smoke signal along line 56 that is received within the central microprocessor 22. Upon receiving the smoke signal, the microprocessor 22 generates an alarm signal to the transducer 24 through the driver 26. The alarm signal generated by the microprocessor 22 has a pattern of alarm pulses followed by quiet periods to create a pulsed alarm signal as is standard in the smoke alarm industry. The details of the generated alarm signal will be discussed in much greater detail below.

As illustrated in FIG. 2, the adverse condition detector 18 includes a hush circuit 58 that quiets the alarm being generated by modifying the operation of the smoke detector ASIC 54 upon activation of the test switch 60. If the test switch 60 is activated during the generation of the alarm signal due to smoke detection by the smoke sensor 52, the microprocessor 22 will output a signal on line 62 to activate the hush circuit 58. The hush circuit 58 adjusts the smoke detection level within the smoke detector ASIC 54 for a selected period of time such that the smoke detector ASIC 54 will moderately change the sensitivity of the alarm-sensing threshold for the hush period. The use of the hush circuit 58 is well known and is described in U.S. Pat. Nos. 4,792,797 and RE33,920, incorporated herein by reference.

At the same time the microprocessor 22 generates the smoke alarm signal to the transducer 24, the microprocessor 22 activates a plurality of LEDs 63, 64 and 65 to provide a visual indication to a user that the microprocessor 22 is generating a smoke alarm signal. The specifics of the operation of the LEDs 63, 64 and 65 by the microprocessor control unit 22 will be described in much greater detail below. Thus, the smoke LEDs 63, 64 and 65 and the carbon monoxide LED 50, in addition to the different audible alarm signal patterns, allow the user to determine which type of alarm is being generated by the microprocessor 22. The detector 18 further includes a low-battery LED 66.

When the microprocessor 22 receives the smoke signal on line 56, the microprocessor 22 generates an interconnect signal through the I/O port 72. In the preferred embodiment of the invention, the interconnect signal is delayed after the beginning of the alarm signal generated to activate the transducer 24. However, the interconnect signal could be simultaneously generated with the alarm signal while operating within the scope of the present invention. The I/O port 72 is coupled to the common conduit 20 (FIG. 1) such that multiple adverse condition detectors 18 can be joined to each other and sent into an alarm condition upon detection of an adverse condition in any of the adverse condition detectors 18.

Referring back to FIG. 2, the adverse condition detector 18 includes both a digital interconnect interface 74 and a legacy interconnect interface 76 such that the microprocessor 22 can both send and receive two different types of signals through the I/O port 72. The digital interconnect interface 74 is utilized with a microprocessor-based adverse condition detector 18 and allows the microprocessor 22 to communicate digital information to other adverse condition detectors through the digital interconnect interface 74 and the I/O port 72.

As an enhancement to the adverse condition detector 18 illustrated in FIG. 2, the legacy interconnect interface 76 allows the microprocessor 22 to communicate to so-called "legacy alarm" devices. The prior art legacy alarm devices issue a continuous DC voltage along the interconnect common conduit 20 to any interconnected remote device. In the event that a microprocessor-based detector 18 is utilized in the same system with a prior art legacy device, the legacy interconnect interface 76 allows the two devices to communicate over the IO port 72.

A test equipment interface 78 is shown connected to the microprocessor 22 through the input line 80. The test equipment interface 78 allows test equipment to be connected to the microprocessor 22 to test various operations of the microprocessor and to possibly modify the operating instructions contained within the microprocessor 22.

An oscillator 82 is connected to the microprocessor 22 to control the internal clock within the microprocessor 22, as is conventional.

During normal operating conditions, the adverse condition detector 18 includes a push-to-test system 60 that allows the user to test the operation of the adverse condition detector 18. The push-to-test switch 60 is coupled to the microprocessor 22 through input line 84. When the push-to-test switch 60 is activated, the voltage $V_{DD}$ is applied to the microprocessor 22. Upon receiving the push-to-test switch signal, the microprocessor generates a test signal on line 86 to the smoke sensor via chamber push-to-test circuit 88. The push-to-test signal also generates appropriate signals along line 48 to test the CO sensor and circuit 46.

The chamber push-to-test circuit 88 modifies the output of the smoke sensor such that the smoke detector ASIC 54 generates a smoke signal 56 if the smoke sensor 52 is operating correctly, as is conventional. If the smoke sensor 52 is operating correctly, the microprocessor 22 will receive the smoke signal on line 56 and generate a smoke alarm signal on line 90 to the transducer 24. As discussed previously, upon depression of the push-to-test switch 60, the transducer 24 generates an audible alarm signal.

Figure 3:
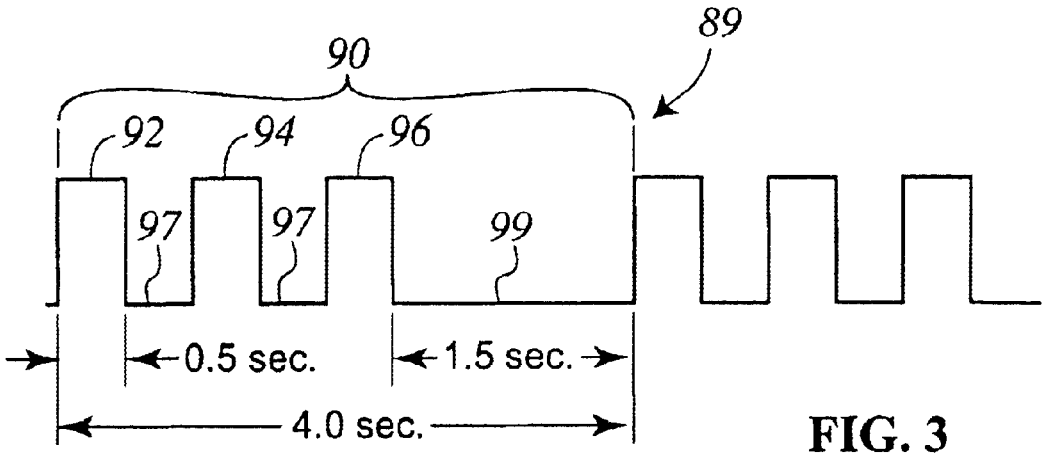
FIG. 3 is an illustration of the alarm signal produced by the adverse condition detector of the present invention.

Referring now to FIG. 3, thereshown is the standard format for an audible smoke alarm signal 89 generated by the adverse condition detector 18. As illustrated, the smoke alarm signal 89 has an alarm period 90 that includes three alarm pulses 92, 94 and 96 each having a pulse duration of 0.5 seconds separated by an off period 97 of 0.5 seconds. After the third alarm pulse 96 is generated, the temporal signal has an off period 99 of approximately 1.5 seconds such that the overall period 90 is 4.0 seconds. After completion of the first alarm period 90, the period is continuously repeated as long as an adverse condition exists.

In addition to generation of the audible alarm signal 89 shown in FIG. 3, the adverse condition detector 18 of the present invention also generates a visual alarm signal to indicate to the user that smoke has been sensed by the smoke sensor 52. In accordance with the present invention, the visual alarm signal is generated to provide a visual indication to the user that visually simulates the actual type of adverse condition being detected. Specifically, in the embodiment of the invention illustrated, the detector 18 creates a visual alarm signal that simulates the appearance of a flickering flame when the smoke sensor 52 is sensing smoke and the smoke detector ASIC 56 is generating a smoke detection signal.

In the embodiment of the invention illustrated in FIG. 2, the detector 18 is able to generate a visual alarm signal that simulates a flickering flame by sequentially activating and deactivating a plurality of visual indicators, such as the smoke LEDs 63, 64 and 65, in a "random" pattern. In the embodiment of the invention illustrated in FIG. 2, the first smoke LED 63 is a red LED, the second smoke LED 64 is an orange LED and the third smoke LED 65 is a yellow LED. By sequentially operating the LEDs 63–65, the microprocessor control unit 22 can give the visual appearance of a flickering flame when viewed from below the adverse condition detector 18. The pattern of operation of the smoke LEDs 63–65 is stored in the microprocessor control unit 22 as an operation sequence such that the LEDs 63–65 can be operated to simulate the appearance of a flame. It is important to note that any actual operational sequence can be utilized while operating within the scope of the present invention as long as the operational sequence operates the LEDs 63–65 in a manner that simulates a flame.

In the embodiment of the invention illustrated in FIG. 2, the adverse condition detector 18 can at times be operated by only the battery 40. Since the detector 18 includes three separate smoke LEDs 63, 64 and 65, the simultaneous activation of all three LEDs would result in excessive LED currents, which would cause a reduction in the life of the battery 40. Therefore, in accordance with the present invention, only one of the smoke LEDs 63–65 will be illuminated at a time to minimize the amount of LED current utilized to generate the visual alarm signal.

Referring back to FIG. 3, in accordance with the embodiment of the present invention, the visual alarm signal is generated only during the off periods 97 of the audible alarm signal 89. Thus, the smoke LEDs 63–65 are all deactivated when the audible horn is on during the alarm pulses 92, 94 and 96. During the off periods 97, the smoke LEDs 63–65 are activated one at a time based on an operational sequence stored in the microprocessor control unit 22. The smoke LEDs 63–65 were selected to be off during the alarm pulses 92, 94 and 96 to maintain the audibility of the horn transducer 24 by avoiding additional current drain from the LEDs during the simultaneous operation of the LEDs and the horn 24.

As described previously, the off periods 97 of the audible alarm signal 89 in the embodiment of the invention illustrated have a duration of approximately 500 ms fitted between the alarm pulses having the same 500 ms duration. In accordance with the invention, the inventor has determined that the activation period for each of the smoke LEDs 63–65 will be 10 ms, although other durations are clearly possible. Thus, fifty 10 ms time slots or activation periods can occur during each 500 ms off period 97. During each of the fifty time slots or activation periods, the microprocessor control unit 22 activates only one of the smoke LEDs 63–65. Thus, the operational sequence and pattern stored within the microprocessor control unit 22 requires 450 locations of memory. These 450 locations of memory are allocated to the three smoke LEDs, each having fifty time slots of operation during each off period, multiplied by the three off periods that occur during each cycle of the audible alarm signal. A small sample of the visual alarm operational sequence is set forth below in Table 1.

TABLE 1

| Time | Horn | LED 1 | LED 2 | LED 3 |
|---|---|---|---|---|
| 0–0.500 | ON | OFF | OFF | OFF |
| 0.510 | OFF | ON | OFF | OFF |
| 0.520 | OFF | OFF | ON | OFF |
| 0.530 | OFF | OFF | OFF | ON |
| 0.540 | OFF | OFF | ON | OFF |
| 0.550 | OFF | ON | OFF | OFF |
| 0.560 | OFF | OFF | OFF | ON |
| 0.570 | OFF | ON | OFF | OFF |
| 0.580 | OFF | OFF | ON | OFF |
| . | . | . | . | . |
| . | . | . | . | . |
| . | . | . | . | . |
| 0.990 | OFF | OFF | OFF | OFF |
| 1.000–1.5 | ON | OFF | OFF | OFF |

As illustrated in Table 1, the horn is operated for the first 500 ms, as illustrated by the alarm pulse 92 in FIG. 3. The horn is then quiet for the next 500 ms, which corresponds to the first off period 97. During the first off period, the LEDs 63–65 are operated as shown in Table 1.

Only a portion of the fifty time slots are set forth in Table 1, since the actual sequence of operation can be changed while operating within the scope of the present invention. It should be understood that the operational sequence for the three smoke LEDs 63–65 of the present invention is shown for illustrative purposes only, and should form no part of the present invention. Instead, it should be understood that a "pseudo-random" pattern of operating the three smoke LEDs 63–65 is the focus of the sequence and other sequences can be utilized while operating within the scope of the present invention.

As described previously, the microprocessor control unit 22 shown in FIG. 2 includes 450 locations of memory allocated to the LED operational sequence. The 450 memory locations are dictated by the requirements of the audible alarm signal 89 shown in FIG. 3. Presently, smoke alarms produced for use in the Canadian market include a different type of audible alarm signal that has a four second overall time period with four horn modulations per second, for a total of sixteen modulations per cycle. If the visual alarm signal is generated only during off periods of the Canadian alarm signal, there are 16 off periods available, each having a possibility of eight 10 ms time slots for each of the three separate smoke LEDs 63, 64 and 65. Thus, if the adverse condition detector is utilized in the Canadian market, the microprocessor control unit 22 requires 384 locations of memory to create the LED flickering effect. It should be understood that the number of memory locations allocated within the microprocessor control unit 22 is dependent upon the type of audible alarm signal 89 being generated by the microprocessor control unit 22.

Figure 4:
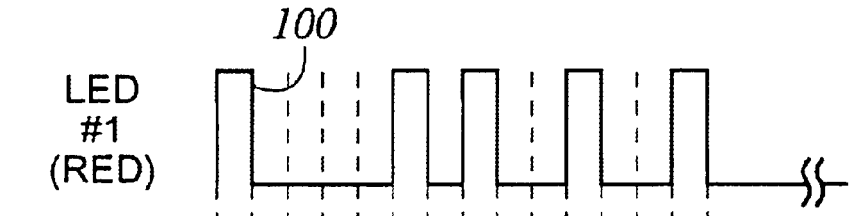
FIG. 4 is an illustration of the sequence of operation of the first smoke LED by the control unit.
Figure 5:
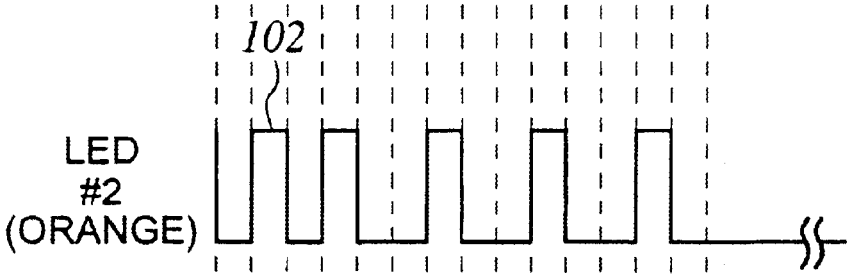
FIG. 5 is an illustration of the sequence of operation of the second smoke LED by the control unit.
Figure 6:
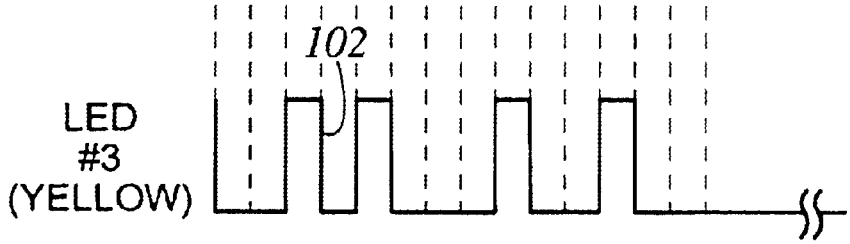
FIG. 6 is an illustration of the sequence of operation of the third smoke LED by the control unit.

Referring now to FIGS. 4–6, thereshown is a portion of the visual alarm signal including the sequence of operation of the LEDs 63, 64 and 65 set forth in Table 1 during the first off period 97 of the audible alarm signal 89 illustrated in FIG. 3. As illustrated in FIGS. 4–6, the first smoke LED 63 is activated for the first 10 ms activation periods, as illustrated by pulse 100. While the first smoke LED is being operated, the remaining LEDs 64 and 65 are off, as illustrated in FIGS. 5 and 6.

After the end of the first activation period, the pulse 100 terminates and the second LED 64 is activated, as illustrated by pulse 102. During the second activation period, only the second smoke LED 64 is activated while the smoke LEDs 63 and 65 are off.

During the next activation period, the third LED 64 is activated, as illustrated by pulse 104, while the first and second smoke LEDs 63 and 64 are turned off. This process is repeated for each activation period until the expiration of the off period 97 of the audible alarm signal 89. During the next off period, another stored operational sequence is initiated to create the flickering pattern to simulate a flame.

As can be understood in FIGS. 4–6, only one of the smoke LEDs 63–65 is activated at any time during the generation of the visual alarm signal. Although the requirement that only one of the smoke LEDs 63–65 be activated at a given time to conserve battery power, it should be understood that if power consumption is not an issue, more than one of the smoke LEDs 63–64 could be activated at the same time while operating within the scope of the present invention. Further, if the power supply is able to generate an adequate amount of current, the visual alarm signal could be generated during the entire duration of the audible alarm signal 89, not just the off period 97 as described in the present invention.

In the embodiment of the invention illustrated in FIG. 2, the smoke LEDs 63–65 each have a different color, preferably red, orange and yellow. However, it is contemplated by the inventor that each of the smoke LEDs 63–65 could be replaced by a bi-color or tri-color LED that is capable of generating more than one color of light. A bi-color device can produce two single colors and multiple shades of color between the two main colors, for instance a red/green LED can produce yellow light if both LED elements are energized simultaneously. By appropriately modulating the currents in each element, the spectrum of color can range smoothly from red, through orange, to yellow, through yellow-green, and finally to green, including an near-infinite number of intermediate shades. A tri-color LED can emulate the entire visible color spectrum by appropriate energization of its elements. If each of the smoke LEDs 63–65 were replaced by a bi-color or tri-color device, the microprocessor control unit 22 would be configured to "randomly" generate the multiple colors to create a flickering flame effect. To do this, different memory locations would be allocated in the microprocessor control unit 22 such that the microprocessor control unit 22 could control the operation of the LEDs accordingly.

Figure 7:
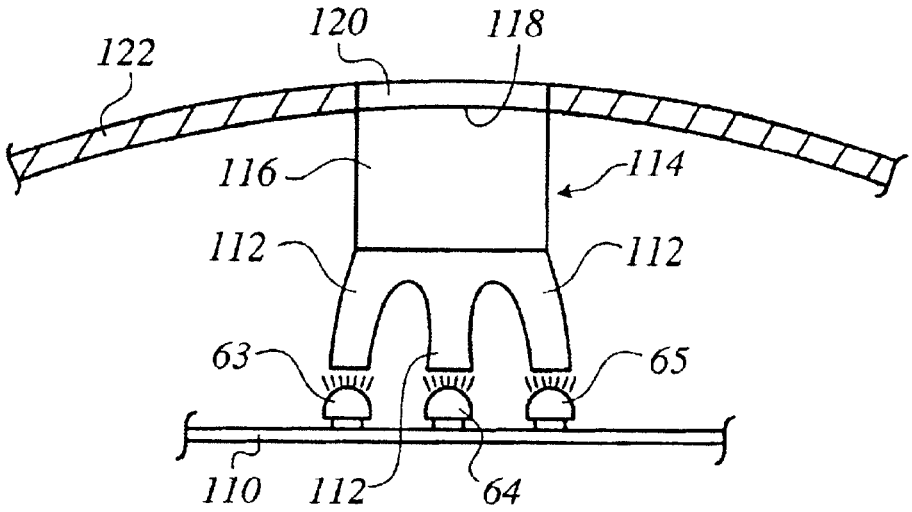
FIG. 7 is a partial section view illustrating the mounting of the smoke LEDs to a printed circuit board and utilization of a light pipe to direct the generated light for viewing from a slot in the detector housing.

Referring now to FIG. 7, thereshown is a preferred implementation of the plurality of smoke LEDs 63, 64 and 65 in the detector. As illustrated, each of the LEDs 63–65 is mounted to a printed circuit board 110 in a side-by-side relationship. Preferably, the LEDs 63–65 are mounted in a straight line, although other mountings on the circuit board 110 are contemplated as being within the scope of the present invention.

As illustrated, each of the LEDs is positioned between a leg 112 of a light pipe 114. The light pipe 114 is a plastic component that is used to direct light from the LEDs to a remote location. As illustrated in FIG. 7, the light pipe 114 includes a main body 116 having an outlet end 118 positioned below a slot 120 formed in the plastic housing 122 of the adverse condition detector of the present invention. The single light pipe 114 directs the light from each of the three LEDs 63, 64 and 65 to the common slot 120 such that the light emitted by the LEDs can be viewed from the exterior of the housing 122. The actual physical configuration of the light pipe 114 forms no part of the present invention except that the light pipe 114 allows the light from the three LEDs 63, 64 and 65 to be viewed through the same slot 120.

Although the preferred embodiment of the invention is described as having a light pipe 114 that can be viewed through a slot 120 formed in the housing 122, it should be understood that the specific manner in which the light generated by the visual indicators is viewed forms no part of the present invention. For example, it is contemplated that the housing could have a transparent, translucent or thin section that allows the light from the visual indicators to be seen from beneath the detector. Alternatively, it is contemplated that the light generated by the visual indicators could be projected onto the ceiling and viewed from below by the user. In any event, the visual alarm signal being generated by the detector must be viewable by the user such that the user can visually correlate the alarm signal with a type of adverse condition being detected.

In the present invention, the colors of the smoke LEDs 63–65 are selected such that when the LEDs 63–65 are operated by the microprocessor control unit 22, the smoke LEDs 63–65 will simulate the appearance of a flame. Thus, the home occupant will be able to simply look at the adverse condition detector and see the flickering "flame" created by the smoke LEDs 63–65 and immediately be informed of the type of adverse condition being detected.

Although the present invention is particularly suited for use with a smoke detector, it is contemplated that the smoke LEDs 63–65 could be replaced by other types of visual indicators, such as an LCD color screen or other visual device while operating within the scope of the present invention. It is important that the microprocessor control unit 22 be able to generate a visual alarm signal that allows the home occupant to quickly determine the type of adverse condition being detected without having to recall the meaning of the specific audible pattern of the audible alarm signal. Additionally, the adverse condition detector of the present invention allows the user to identify the visual alarm signal with the type of adverse condition being detected without having to understand a spoken command from the detector, as was the case in prior art detectors.

Various alternatives and embodiments are contemplated as being within the scope of the following claims particularly pointing out and distinctly claiming the subject matter regarded as the invention.

I claim:

1. An adverse condition detection apparatus operable to detect an adverse condition and generate a visual alarm signal to indicate the presence of the adverse condition, the apparatus comprising:

an adverse condition sensor operable to detect the adverse condition and generate a detection signal;

a control unit coupled to the adverse condition sensor for receiving the detection signal, the control unit being operable to control the generation of both the visual alarm signal and an audible alarm signal during the generation of the detection signal;

an audible indicator coupled to the control unit, wherein the control unit activates the audible indicator to generate an audible alarm signal upon detection of the adverse condition; and a visual indicator coupled to the control unit, the visual indicator being operable to generate the visual alarm signal upon detection of the adverse condition, wherein the visual indicator includes at least two LED's that each emit light of a different color, the LED's being selectively operated such that the visual alarm signal visually simulates the type of adverse condition being detected.

2. The apparatus of claim 1 wherein the visual indicator is a color LCD screen.

3. The apparatus of claim 1 wherein each of the LED's is a multi-color LED.

4. The apparatus of claim 1 wherein only one of the visual indicators is operated at a time by the control unit.

5. The apparatus of claim 4 wherein each of the visual indicators are selectively operated by the control unit for individual activation periods, wherein the visual alarm signal includes a plurality of sequential activation periods during which only one of the visual indicators is operated at a time.

6. The apparatus of claim 1 wherein the visual indicators comprise a yellow LED, an orange LED and a red LED.

7. The apparatus of claim 6 wherein the visual indicators are selectively operated by the control unit in a pattern to visually simulate the appearance of a flame.

8. The apparatus of claim 1 wherein the audible alarm signal includes a plurality of alarm pulses each separated by an off period, wherein the control unit operates the visual indicator only during the off periods of the alarm signal.

9. The apparatus of claim 8 wherein each of the visual indicators is operated by the control unit for an activation period, wherein the activation period is shorter than the off period between the alarm pulses of the alarm signal such that multiple activation periods occur during each off period of the audible alarm signal.

10. The apparatus of claim 1 wherein the control unit includes a stored operational sequence for the activation of the visual indicators, wherein the visual indicators are selectively activated based upon the stored operational sequence.

11. The apparatus of claim 1 wherein the adverse condition detection apparatus includes a housing for enclosing the adverse condition sensor, the control unit and the visual indicators, wherein the visual indicators can be seen from the exterior of the housing.

12. A method of operating an adverse condition detection apparatus to generate a visual alarm signal that visually stimulates the type of adverse condition detected by the apparatus, the method comprising the steps of:

providing an adverse condition sensor operable to generate a detection signal upon sensing the presence of the adverse condition;

receiving the detection signal in a control unit of the apparatus;

providing at least two visual indicators coupled to the control unit, the combination of visual indicators being selectively operable to emit light of at least two different colors;

selectively activating and deactivating the visual indicators in a simulation pattern to create the visual alarm signal, wherein the simulation pattern visually simulates the type of adverse condition being detected.

13. The method of claim 12 wherein the adverse condition sensor is a smoke sensor.

14. The method of claim 13 wherein the visual indicators comprise a red LED, an orange LED, and a yellow LED.

15. The method of claim 12 further comprising the step of storing an operational sequence in the control unit, the operational sequence defining the sequence of operation of the visual indicators by the control unit.

16. The method of claim 15 wherein the control unit activates only one of the visual indicators at a time.

17. The method of claim 16 wherein each of the visual indicators is activated for an activation period, wherein the visual alarm signal includes a plurality of sequential activation periods during which only one of the visual indicators is activated.

18. The method of claim 13 wherein the operational sequence controls the operation of the visual indicators to simulate the appearance of a flame.

19. A method of operating an adverse condition detection apparatus having an adverse condition sensor operable to detect an adverse condition, the method comprising the steps of:

providing a control unit coupled to the sensor to receive a detection signal upon the sensor detecting the adverse condition;

activating an audible indicator to generate an audible alarm signal upon receipt of the detection signal by the control unit; and selectively activating and deactivating at least two visual indicators in a pattern that visually simulates the type of adverse condition being sensed, wherein the combination of the visual indicators are operable to generate at least two different colors of light.

20. The method of claim 19 further comprising the step of storing an operational sequence in the control unit, the operational sequence defining the sequence of operation of the visual indicators by the control unit.

21. The method of claim 19 wherein each of the visual indicators is operable by the control unit for an activation period, wherein the operational sequence includes a stored sequence of activation periods.

22. The method of claim 20 wherein only one of the visual indicators is operable at a time by the control unit.

23. The method of claim 2 wherein the audible alarm signal includes a series of alarm pulses each separated by an off period, wherein the visual indicators are activated by the control unit only during the off period of the audible alarm signal.

* * * * *